US006043015A

United States Patent [19]

Tingler et al.

[11] Patent Number: 6,043,015

[45] Date of Patent: Mar. 28, 2000

[54] COATING COMPOSITIONS AND IMAGING ELEMENTS CONTAINING A LAYER COMPRISING SOLVENT-DISPERSED POLYURETHANES

[75] Inventors: Kenneth L. Tingler, Rochester; Charles C. Anderson, Penfield, both of N.Y.

[73] Assignee: Eastman Kodak Company, Rochester, N.Y.

[21] Appl. No.: 09/201,943

[22] Filed: Dec. 1, 1998

[51] Int. Cl.[7] ..... G03C 1/93; G03C 1/805; G03C 1/76; G03C 8/56

[52] U.S. Cl. ..... 430/533; 430/200; 430/213; 430/262; 430/531; 430/527

[58] Field of Search ..... 430/531, 527, 430/530, 533, 200, 213, 262

[56] References Cited

U.S. PATENT DOCUMENTS

| | | | |
|---|---|---|---|
| 3,880,796 | 4/1975 | Christenson et al. . | |
| 3,929,693 | 12/1975 | Hochberg . | |
| 4,025,474 | 5/1977 | Porter, Jr. et al. . | |
| 4,115,472 | 9/1978 | Porter, Jr. et al. | 260/836 |
| 4,147,688 | 4/1979 | Makhlouf et al. | 260/33.6 EP |
| 4,336,177 | 6/1982 | Backhouse et al. | 523/201 |
| 4,829,127 | 5/1989 | Muramoto et al. | 525/309 |
| 5,006,451 | 4/1991 | Anderson et al. | 430/527 |
| 5,340,676 | 8/1994 | Anderson et al. | 430/527 |
| 5,597,680 | 1/1997 | Wang et al. | 430/527 |
| 5,597,681 | 1/1997 | Anderson et al. | 430/527 |
| 5,679,505 | 10/1997 | Tingler et al. | 430/527 |
| 5,695,919 | 12/1997 | Wang et al. | 430/527 |
| 5,695,920 | 12/1997 | Anderson et al. | 430/530 |
| 5,707,791 | 1/1998 | Ito et al. | 430/530 |
| 5,786,134 | 7/1998 | Nair et al. | 430/531 |
| 5,804,360 | 9/1998 | Schell et al. | 430/527 |
| 5,932,405 | 8/1999 | Anderson et al. | 430/531 |
| 5,952,164 | 9/1999 | Anderson et al. | 430/531 |

*Primary Examiner*—Richard L. Schilling
*Attorney, Agent, or Firm*—Andrew J. Anderson

[57] ABSTRACT

An imaging element is described comprising a support material having thereon at least one image-forming layer and at least one layer coated from a composition containing a dispersion of aqueous dispersible polyurethane polymer particles dispersed in a continuous liquid phase comprising primarily water-miscible organic solvent. A coating composition for coating a polyurethane layer on a moving film support is also described comprising a dispersion of aqueous dispersible polyurethane polymer particles dispersed in a continuous liquid phase comprising primarily water-miscible organic solvent, said composition having a concentration of from 0.1 to 20 wt percent total solids and a viscosity of from 0.5 to 50 centipoise. The coating compositions in accordance with this invention have unique coating rheologies and provide layers for imaging elements having excellent film forming and physical and mechanical properties.

19 Claims, No Drawings

COATING COMPOSITIONS AND IMAGING ELEMENTS CONTAINING A LAYER COMPRISING SOLVENT-DISPERSED POLYURETHANES

FIELD OF THE INVENTION

This invention relates to an imaging element comprising a support material having thereon at least one image-forming layer and at least one layer coated from a composition containing a polyurethane dispersed in liquid organic medium, and to coating compositions for coating such layer.

BACKGROUND OF THE INVENTION

Support materials for an imaging element often employ layers comprising glassy, hydrophobic polymers such as acrylics, styrenics, and cellulose esters, for example. One typical application is as a backing layer to provide resistance to abrasion, scratch, blocking, and ferrotyping. For coating applications, the glassy polymers are normally dissolved in a solvent at very low solids to ensure low coating solution viscosities for good coatability at high coating speeds on a moving film support. Coating techniques employed include single or multilayer extrusion dies (commonly referred to as X-hoppers), air knife, roller coating, meyer rods, knife over roll, and so on.

For coating solutions comprising soluble polymers of reasonably high molecular weights, for example, larger than 50,000, the solution viscosity is a strong function of polymer concentration. For example, Elvacite 2041, a methyl methacrylate polymer sold by E.I. DuPont de Nemours and Co., has been described in the photographic art to form scratch protective layers for photographic materials. The polymer is normally dissolved in an organic solvent such as methylene chloride to form a clear solution. At concentrations above, for example, 4 to 5 weight %, the Elvacite 2041 solution viscosity is at least 20 centipoise at ambient temperature. Those viscosity values are too high for coating applications by, for example, certain roller coating or air-knife coating techniques, which require a coating solution viscosity in the range of from one to several centipoise. Therefore, photographic manufactures have to keep the solid concentration low to provide low solution viscosities and good coatability at high coating speeds.

Polymer solutions with low solids are useful for applications where lower dry coating coverages (less than about 300 mg/m$^2$) can meet the physical and mechanical properties requirements for an imaging system. However, more advanced imaging applications need higher dry coating coverages for better physical and mechanical properties. To obtain high dry coating coverages, either more coating solution per unit area (wet coverage) has to be applied when using low viscosity/low solids polymer solutions, or higher viscosity/higher solids solutions must be used. As stated above, however, many coating applications cannot tolerate high viscosity/ high solids polymer solutions, as such solutions cannot be coated at low wet coverages at high coating speeds. Some coating methods may allow one to coat high viscosity polymer solutions at high wet coverages, but they still suffer from several disadvantages. For example, in general, higher wet coverages mean more solvent recovery and higher cost for drying. Furthermore, due to both manufacturing limitations and various physical and mechanical property requirements for imaging element, wet coverages cannot be increased under certain conditions and for certain applications. For example, high wet coating coverages and the high levels of solvent retained in the film support as a result of these high wet coverages may have a significant impact on both dimensional stability and sensitometric properties of an imaging element. One may use resins of low molecular weight to lower the solution viscosity. However, the resultant dry coatings may not have adequate physical and mechanical properties.

Alternative approaches employing low viscosity, dispersed polymer particle-containing coating compositions have been described for paint and automotive coating industries. For example, U.S. Pat. No. 4,336,177 describes a solvent coating composition comprising non-aqueous dispersible composite polymer particles larger than 0.1 μm. The particle has a core with a glass transition temperature (Tg) of about 10° C. less than the polymerization reaction temperature. The particles are stabilized by block or grafting copolymers and can be transferred directly from aqueous medium to a non-aqueous medium. U.S. Pat. No. 4,829,127 describes a coating composition comprising composite resin particles. Such particles are prepared by solution polymerization techniques in reaction vessels containing initiator, solvent, polymerizable monomers, and crosslinked particles. U.S. Pat. No. 3,929,693 describes a coating composition comprising a solution polymer and polymer particles, where the polymer particles have a crosslinked rubbery core below 60° C. and a grafted shell having molecular weight of 1,000 to 150,000. Reportedly, such coating compositions are more stable toward premature separation and flocculation. U.S. Pat. No. 3,880,796 describes a coating composition comprising thermosetting polymer particles containing insoluble microgel particles having a particle size of from 1 to 10 μm. U.S. Pat. No. 4,147,688 describes a dispersion polymerization process of making crosslinked acrylic polymer microparticles having a particle size of from 0.1 to 10 μm. U.S. Pat. No. 4,025,474 describes a coating composition comprising a hydroxy-functional, oil-modified or oil-free polyester resin, aminoplast resin, and 2 to 50% of crosslinked polymer microparticles (0.1 to 10 μm) made by dispersion polymerization process. U.S. Pat. No. 4,115,472 describes a polyurethane coating composition comprising an ungelled hydroxy-containing urethane reaction product and insoluble crosslinked acrylic polymer microparticles (0.1 to 10 μm) made by a dispersion polymerization process. Such coatings are reportedly useful for automotive industries.

There are significant differences in designing coating compositions for photographic applications from those for paint and automotive coating industries. The coating techniques and coating delivery systems are different so that they need different coating rheologies. The drying time in exterior and interior paint and architectural coating applications is on the order of hours and days, and in the automobile industry on the order of 10 to 30 min. However, in the photographic support manufacturing process the drying time for coatings is typically on the order of seconds. Often the drying time for solvent-borne coatings is as brief as 10–30 seconds for high speed coating applications. These differences put additional stringencies on the coating composition for photographic materials. For example, the coating viscosity frequently needs to be on the order of less than about 10 centipoise, and more often less that 5 centipoise, instead of on the order of one hundred to several thousand centipoise as in other coating industries. A typical dry coating thickness for photographic materials is on the order of less than 2 μm, and more often less than 1 μm. Film formation and dried film quality are especially critical. The tolerance on defects caused by polymer gel slugs, gelled particles, dust, and dirt is extremely low. This requires special precautions in delivery processes. The coating solutions need to be very stable toward, for example, high speed filtration and high shear.

U.S. Pat. Nos. 5,597,680, 5,597,681, and 5,695,919 describe coating compositions for imaging elements that contain core-shell polymer particles dispersed in liquid organic medium. Such coating compositions are stable and have low viscosity at high solids. However, there is a need to provide organic solvent based coating compositions that yield dried layers with even superior physical and mechanical properties compared with these core-shell polymers.

Aqueous coating compositions comprising water dispersible polymer particles have been reported to be useful for some applications For example, they have been used as "priming" or subbing layers on film support to act as adhesion promotion layers for photographic emulsion layers, and used as barrier layers over, for example, a vanadium pentoxide antistatic subbing layer to prevent the loss of antistatic properties after film processing as described in U.S. Pat. No. 5,006,451. U.S. Pat. No. 5,679,505 describes an improved motion picture print film with a protective overcoat containing a polyurethane. Preferably the polyurethane is a water dispersible polyurethane. While these coating compositions are attractive from environmental considerations, the slow evaporation rate of water coupled with its extremely high heat of vaporization causes drying problems which are either not normally encountered or can be easily overcome in solvent-borne systems. Therefore, for manufacturing processes with conventional organic solvent drying capacity, the use of water-borne coating compositions often leads to very unsatisfactory results. In addition, solvent based coatings are preferred when the substrate or layer to be overcoated are moisture sensitive.

It can be seen that various approaches have been attempted to obtain useful organic solvent-based coating compositions with low viscosity and high percent solids. While the aforementioned prior art references relate to some aspects of the present invention, they are deficient with regard to simultaneously satisfying all the physical, chemical, and manufacturing requirements for a solvent-borne coating for more advanced imaging applications. The present invention provides coating compositions, and imaging elements containing a layer coated from such coating compositions, which meet all of these requirements while avoiding the problems and limitations of the prior art.

SUMMARY OF THE INVENTION

In accordance with one embodiment of the present invention, an imaging element is described comprising a support material having thereon at least one image-forming layer and at least one layer coated from a composition containing a dispersion of aqueous dispersible polyurethane polymer particles dispersed in a continuous liquid phase comprising primarily water-miscible organic solvent. In accordance with a further embodiment of the invention, a coating composition for coating a polyurethane layer on a moving film support is described comprising a dispersion of aqueous dispersible polyurethane polymer particles dispersed in a continuous liquid phase comprising primarily water-miscible organic solvent, said composition having a concentration of from 0.1 to 20 wt percent total solids and a viscosity of from 0.5 to 50 centipoise. The coating compositions in accordance with this invention have unique coating rheologies and provide layers for imaging elements having excellent film forming and physical and mechanical properties.

DESCRIPTION OF THE INVENTION

The imaging elements of this invention can be of many different types depending on the particular use for which they are intended. Such elements include, for example, photographic, electrophotographic, electrostatographic, photothermographic, migration, electrothermographic, dielectric recording and thermal-dye-transfer imaging elements. Photographic elements can comprise various polymeric films, papers, glass, and the like, but both cellulose acetate and polyester supports well known in the art are preferred. The thickness of the support is not critical. Support thickness of from 50 to 250 microns (0.002 to 0.010 inches) can typically be used.

Details with respect to the composition and function of a wide variety of different imaging elements and image-forming layers for such elements are provided in U.S. Pat. No. 5,340,676 and references described therein. The present invention can be effectively employed in conjunction with any of the image-forming layers and imaging elements described in the '676 patent.

The coating compositions of the invention comprise a polyurethane dispersed in an organic solvent medium. The coating compositions are prepared by dispersing an aqueous dispersible polyurethane into a water miscible organic solvent or solvent mixture. Conventional organic solvent-based polyurethane coating compositions utilize solvent soluble polyurethanes that are very viscous and require the use of solvents such as tetrahydrofuran, dimethylformamide, and toluene to dissolve the polyurethane. Such solvents are undesirable due to environmental or health concerns or incompatibility with imaging element manufacturing processes and solvent recovery operations. As will be shown in the examples presented later, the present invention provides organic solvent-based coating compositions which have significantly lower viscosities at high % solids compared with conventional, solvent-soluble polyurethanes and give dried layers with excellent physical and mechanical properties. In addition, the coating compositions of the invention utilize more desirable solvents such as acetone, methanol, ethanol, propanol, ethyl acetate and propyl acetate.

The preparation of aqueous polyurethane dispersions is well-known in the art. All the preparation methods share two common features. In all cases, the first step is the formation of a medium molecular weight isocyanate terminated prepolymer by the reaction of a suitable diol or polyol with a stoichiometric excess of diisocyanate or polyisocyanate. The polymer to be dispersed in water is functionalized with water-solubilizing/dispersing groups which are introduced either into the prepolymer prior to chain extension, or are introduced as part of the chain extension agent. Therefore, small particle size stable dispersions can frequently be produced without the use of an externally added surfactant.

In the solution process, the isocyanate terminated polyurethane prepolymer is chain extended in solution in order to prevent an excessive viscosity being attained. The preferred solvent is acetone, and hence this process is frequently referred to as the acetone process. The chain extender can, for example, be a sulfonate functional diamine, in which case the water-solubilizing/dispersing group is introduced at the chain extension step. The chain extended polymer is thus more properly described as a polyurethane urea. Water is then added to the polymer solution without the need for high shear agitation, and after phase inversion a dispersion of polymer solution in water is obtained.

In the prepolymer mixing process, a hydrophilically modified isocyanate terminated prepolymer is chain extended with diamine or polyamine at the aqueous dispersion step. This chain extension is possible because of the preferential reactivity of isocyanate groups with amine rather than with water. In order to maintain this preferential reactivity with amine, it is necessary to prevent the water temperature from exceeding the value at which significant reactions occur between water and the isocyanate. The choice of isocyanates is clearly important in this respect. The prepolymer mixing process is extremely flexible in terms of the range of aqueous polyurethane ureas which can be prepared, and has the major advantages that it avoids the use of large amounts of solvent and avoids the need for the final polymer to be solvent soluble.

The ketamine/ketazine process can be regarded as a variant of the prepolymer mixing process. The chain extending agent is a ketone-blocked diamine (ketamine) or ketone-blocked hydrazine (ketazine) which is mixed directly with the isocyanate terminated polyurethane prepolymer. During the subsequent water dispersion step, the ketamine or ketazine is hydrolyzed to generate free diamine or hydrazine respectively, and thus quantitative chain extension takes place. An advantage of the ketamine process over the prepolymer mixing process is that it is better suited for preparing aqueous urethanes based on the more water reactive aromatic isocyanates.

The hot melt process involves the capping of a functionalized isocyanate terminated polyurethane prepolymer with urea at >130° C. to form a biuret. This capped polyurethane (which can be solvent free) is dispersed in water at about 100° C. to minimize viscosity, and chain extension carried out in the presence of the water by the reaction with formaldehyde which generates methylol groups, which in turn self-condense to give the desired molecular weight buildup.

Anionic, cationic, or nonionically stabilized aqueous polyurethane dispersions can be prepared. Anionic dispersions contain usually either carboxylate or sulfonate functionalized co-monomers, e.g., suitably hindered dihydroxy carboxylic acids (dimethylol propionic acid) or dihydroxy sulphonic acids. Cationic systems are prepared by the incorporation of diols containing tertiary nitrogen atoms, which are converted to the quaternary ammonium ion by the addition of a suitable alkylating agent or acid. Nonionically stabilized aqueous polyurethanes can be prepared by the use of diol or diisocyanate co-monomers bearing pendant polyethylene oxide chains. Such polyurethane dispersions are colloidally stable over a broad pH range. Combinations of nonionic and anionic stabilization are sometimes utilized to achieve a combination of small particle size and strong stability, such polyurethane dispersions are often referred to as "universal" polyurethane dispersions.

Polyols useful for the preparation of polyurethane dispersions of the present invention include polyester polyols prepared from a diol (e.g. ethylene glycol, butylene glycol, neopentyl glycol, hexane diol or mixtures of any of the above) and a dicarboxylic acid or an anhydride (succinic acid, adipic acid, suberic acid, azelaic acid, sebacic acid, phthalic acid, isophthalic acid, maleic acid and anhydrides of these acids), polylactones from lactones such as caprolactone reacted with a diol, polyethers such as polypropylene glycols, and hydroxyl terminated polyacrylics prepared by addition polymerization of acrylic esters such as the aforementioned alkyl acrylate or methacrylates with ethylenically unsaturated monomers containing functional groups such as carboxyl, hydroxyl, cyano groups and/or glycidyl groups.

Diisocyanates that can be used are as follows: toulene diisocyanate, tetramethylene diisocyanate, hexamethylene diisocyanate, isophorone diisocyanate, ethylethylene diisocyanate, 2,3-dimethylethylene diisocyanate, 1-methyltrimethylene diisocyanate, 1,3-cycopentylene diisocyanate, 1,4-cyclohexylene diisocyanate, 1,3-phenylene diisocyanate, 4,4'-biphenylene diisocyanate, 1,5-naphthalene diisocyanate, bis-(4-isocyanatocyclohexyl)-methane, 4,4'diisocyanatodiphenyl ether, tetramethyl xylene diisocyanate and the like.

Compounds that are reactive with the isocyanate groups and have a group capable of forming an anion are as follows: dihydroxypropionic acid, dimethylolpropionic acid, dihydroxysuccinic acid and dihydroxybenzoic acid. Other suitable compounds are the polyhydroxy acids which can be prepared by oxidizing monosaccharides, for example gluconic acid, saccharic acid, mucic acid, and the like.

Suitable tertiary amines which are used to neutralize the acid and form an anionic group for water dispersability are trimethylamine, triethylamine, dimethylaniline, diethylaniline, triphenylamine and the like.

Diamines suitable for chain extension of the polyurethane include ethylenediamine, diaminopropane, hexamethylene diamine, hydrazine, amnioethylethanolamine and the like.

The aqueous dispersible polyurethanes suitable for the practice of the present invention include siloxane-containing polyurethanes such as those described in commonly assigned copending applications Ser. Nos. 08/954,373 and 08/955,013 or the polyurethane/vinyl polymer dispersions described in U.S. Pat. No. 5,804,360.

Examples of suitable, commercially-available aqueous dispersible polyurethanes useful in the practice of the present invention include Witcobond W232 and W242 available from Witco Corp., Sancure 898, 815D, 2260, and 12684 available from B.F. Goodrich Corp., and Neorez R966 available from Zeneca Resins Inc.

In the practice of the present invention, the aqueous dispersible polyurethane may be added to a water-miscible organic solvent or solvent mixture with agitation. Alternatively, the water-miscible organic solvent or solvent mixture may be added to the aqueous dispersible polyurethane with agitation. As the water-miscible organic solvent it is meant any solvent which is infinitely soluble in water. The preferred water-miscible organic solvents for the practice of the present invention include, acetone, methanol, ethanol, n-propanol, iso-propanol, N-methyl pyrrolidone, propylene glycol ethers, propylene glycol ether esters, ethylene glycol ethers, ethylene glycol ether esters, and their mixtures. In addition, up to 40 weight % of an organic solvent which is not infinitely soluble in water may be added to the water-miscible solvent prior to addition of the organic solvent mixture to the aqueous dispersible polyurethane or addition of the aqueous dispersible polyurethane to the organic solvent mixture. The organic solvents that may be used in mixtures with water-miscible organic solvents include methyl ethyl ketone, butanol, ethyl acetate, propyl acetate, isopropyl acetate, butyl acetate, toluene, and other organic solvents commonly used in solvent coating applications. In the coating compositions of the present invention which contain an aqueous dispersible polyurethane dispersed in organic medium the continuous phase (i.e., the liquid phase) contains less than 50 weight %, preferably less than 30 weight %, and most preferably less than 20 weight % water, the balance being the organic solvent or organic solvent mixture described above.

It was a surprising result that an aqueous dispersible polyurethane would tolerate the addition of such large volumes of organic solvents such as methanol or acetone. By contrast, other aqueous dispersible polymers such as vinyl latex polymers are coagulated by the addition of, for example, methanol to the latex. In fact, the addition of methanol to a polymer latex is a common method used to isolate the solid polymer.

The coating compositions of the present invention may contain mixtures of the dispersed polyurethane with the solvent dispersible core-shell polymers described in U.S. Pat. Nos. 5,597,680; 5,597,681, and 5,695,919. The coating composition of the present invention can also contain up to about 70 weight %, preferably up to about 50 weight % of solution polymers. The solution polymers are defined as those that are soluble in the desired solvent medium, these include acrylic polymers, cellulose esters, cellulose nitrate, and others.

The coating composition in accordance with the invention may also contain suitable crosslinking agents including aldehydes, epoxy compounds, polyfunctional aziridines, vinyl sulfones, methoxyalkyl melamines, triazines, polyisocyanates, dioxane derivatives such as dihydroxydioxane, carbodiimides, and the like. The crosslinking agents may react with functional groups present on the dispersed polymer and/or solution polymer present in the coating composition.

Matte particles well known in the art may also be used in the coating composition of the invention, such matting agents have been described in *Research Disclosure* No. 308119, published December 1989, pages 1008 to 1009. When polymer matte particles are employed, the polymer may contain reactive functional groups capable of forming covalent bonds with the binder polymer by intermolecular crosslinking or by reaction with a crosslinking agent in order to promote improved adhesion of the matte particles to the coated layers. Suitable reactive functional groups include: hydroxyl, carboxyl, carbodiimide, epoxide, aziridine, vinyl sulfone, sulfinic acid, active methylene, amino, amide, allyl, and the like.

The coating composition of the present invention may also include lubricants or combinations of lubricants to reduce sliding friction of the image elements in accordance with the invention. Typical lubricants include (1) silicone based materials disclosed, for example, in U.S. Pat. Nos. 3,489,567, 3,080,317, 3,042,522, 4,004,927, and 4,047,958, and in British Patent Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc. disclosed in U.S. Pat. Nos. 2,454,043, 2,732,305, 2,976,148, 3,206,311, 3,933,516, 2,588,765, 3,121,060, 3,502,473, 3,042,222, and 4,427,964, in British Patent Nos. 1,263,722, 1,198,387, 1,430,997, 1,466,304, 1,320,757, 1,320,565, and 1,320,756, and in German Patent Nos. 1,284,295 and 1,284,294; (3) liquid paraffin and paraffin or wax like materials such as carnauba wax, natural and synthetic waxes, petroleum waxes, mineral waxes and the like; (4) perfluoro- or fluoro- or fluorochloro-containing materials, which include poly(tetrafluoroethlyene), poly (trifluorochloroethylene), poly(vinylidene fluoride, poly (trifluorochloroethylene-co-vinyl chloride), poly(meth) acrylates, poly(itaconates), or poly(meth)acrylamides containing perfluoroalkyl side groups, and the like. Lubricants useful in the present invention are described in further detail in *Research Disclosure* No.308119, published December 1989, page 1006.

Other additional compounds that can be employed in the coating compositions of the invention include surfactants, coating aids, coalescing aids, inorganic fillers such as non-conductive metal oxide particles, granular, acicular or core-shell conductive metal oxide particles, carbon black, magnetic particles, pigments, dyes, biocides, UV and thermal stabilizers, and other addenda well known in the imaging art.

The compositions of the present invention may be applied as solvent coating formulations containing from 0.1 to 20 weight % total solids (more preferably 3 to 10 weight %) having a viscosity of from 0.5 to 50 centipoise (more preferably 0.5 to 20 centipoise) by coating methods well known in the art. For example, hopper coating, gravure coating, skim pan/air knife coating, and other methods may be used with very satisfactory results. The compositions are particularly useful for coating a polyurethane layer on a moving film support. The coatings are dried at temperatures up to 150° C. to give dry coating weights of 20 $mg/m^2$ to 10 $g/m^2$, more preferably from about 100 $mg/m^2$ to 3 $g/m^2$.

The coating compositions of the present invention are useful for a variety of imaging applications. They can be used in subbing layers, backing layers, interlayers, overcoat layers, receiving layers, barrier layers, stripping layers, mordanting layers, antikinking layers, antistatic layers, transparent magnetic recording layers, and the like.

In a particularly preferred embodiment, the imaging elements of this invention are photographic elements, such as photographic films, photographic papers or photographic glass plates, in which the image-forming layer is a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly (vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the elements of the present invention can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in *Research Disclosure,* Item 36544, September, 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in *Research Disclosure,* Item 36544, September, 1994, and the references listed therein.

The photographic silver halide emulsions utilized in this invention can contain other addenda conventional in the photographic art. Useful addenda are described, for example, in *Research Disclosure,* Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The following examples are used to illustrate the present invention. However, it should be understood that the invention is not limited to these illustrative examples.

The examples demonstrate the benefits of coating compositions comprising a solvent-dispersible polyurethane, and in particular show that the coating compositions of the invention have excellent stability against phase separation and flocculation and superior rheological properties for coating at lower wet coverages for high dry coating weight, and imaging elements in accordance with the invention comprising a layer coated from such coating compositions exhibit good optical clarity, good barrier properties, and excellent abrasion resistance.

EXAMPLES

The most significant advantage of the use of dispersed polyurethanes in accordance with the invention is the low solution viscosity achieved at high solids when compared to other high molecular weight solvent soluble polymers. The following table compares the solution viscosity at high solids of a methylene chloride-soluble polymethyl methacrylate (Elvacite 2041, ICI Chemical) and a methylene chloride-soluble polyurethane (Morthane CA-139, Morton Chemical) to a solvent dispersed polyurethane (Witcobond W232, Witco Corporation) in a methanol-acetone mixture. It can be seen that the solvent-dispersed polyurethane compositions of the invention provide dramatically lower viscosities compared with conventional, solvent-soluble acrylics and polyurethanes that are known in the art.

| | | Solution Viscosity in cps. @ % Solids | | | |
|---|---|---|---|---|---|
| Polymer | Molecular weight | 5% | 10% | 15% | 20% |
| Elvacite 2041 | 396,000 | 27 | 205 | 860 | 4350 |
| Morthane CA-139 | 139,000 | 8 | 40 | 235 | 1060 |
| Witcobond W232 | 236,000 | 4 | 11 | 17 | 23 |

Example 1

A subbed polyester support was prepared by first applying a subbing terpolymer of acrylonitrile, vinylidene chloride and acrylic acid to both sides of the support surface before drafting and tentering so that the final coating weight was about 90 mg/m$^2$. An antistat formula was coated on one side of the subbed, polyester support to give a total dry coating weight of about 12 mg/m$^2$. The antistat formula consisted of the following components prepared at 0.078% total solids.

| | |
|---|---|
| Eastman Kodak terpolymer, 30% solids* | 0.094% |
| Vanadium pentoxide colloidal dispersion, 0.57% solids | 4.972% |
| Triton X-100 (Rohm and Haas), 10% solids | 0.212% |
| Demineralized water | 94.722% |

*terpolymer as described in subbing coat

The antistat coating was coated with a protective layer to give a dry coating weight of about 1000 mg/m $^2$. The protective overcoat layer consisted of the following components:

| | |
|---|---|
| Witcobond W232 aqueous polyurethane dispersion (Witco Chemical), 30% solids | 12.50% |
| Michemlube 160 (Michelman Chemical), 10% solids | 0.20% |
| Methanol | 47.90% |
| Acetone | 30.80% |
| Water | 8.60% |

The above composition had a total solids of 3.75% but the viscosity was only 2.8 cps. The protective overcoat was clear, smooth and provided the antistat layer with both resistance to abrasion and a chemical barrier to processing solutions. The Taber abrasion percent haze value (using ASTM D1044) for the protective overcoat abraded with a CS10F wheel at a 125 gram load for 100 cycles was 12.5%, which represents very good abrasion protection. The internal electrical resistivity (measured using the salt bridge method, described in R. A. Elder, "Resistivity Measurements on Buried Conductive Layers", EOS/ESD Symposium Proceedings, September 1990, pages 251–254.) of the support structure was about 7.8 log ohm/square and remained unchanged after processing the support in a standard ECP-2 Color Print process. The coefficient of friction for the protective overcoat was 0.15 (the coefficient of friction was determined using the methods set forth in ANSI IT 9.4-1992) which is desirable for most photographic film backing applications.

Example 2

An unsubbed cellulose triacetate support was coated with an antistat formula on one side to give a final coating weight of about 30 mg/m$^2$. The antistat formula consisting of the following components was prepared at 0.20% total solids:

| | |
|---|---|
| Cellulose nitrate (SNPE North America, Inc) | 0.16% |
| Vanadium pentoxide colloidal dispersion, 0.57% solids | 6.84% |
| Acetone | 40.00% |
| Ethanol | 47.00% |
| Demineralized water | 6.00% |

The antistat coating was coated with a protective overcoat layer at 1000 mg/m$^2$. The protective overcoat formula consisted of the following components:

| | |
|---|---|
| Witcobond W232 (Witco Chemical), 30% solids | 7.50% |
| Nissan IPA-ST silica (Nissan Chemical), 30% solids | 5.00% |
| Michemlube 160 (Michelman Chemical), 10% solids | 0.20% |
| Methanol | 53.00% |
| Ethyl acetate | 34.30% |

The above composition had a total solids of 3.75% but the viscosity was only 2.1 cps. The overcoat provided a clear, smooth protective layer over the antistat layer. The Taber abrasion percent haze value was a low 9.2%, thus indicating the good abrasion resistance of the protective overcoat. The internal electrical resistivity of this structure was 8.2 log ohm/square and remained unchanged after processing the support in a standard C41 Kodacolor process. The coefficient of friction for the protective overcoat was 0.20, which is well within the desired range for most photographic film backing applications.

Example 3

An antistat formula was prepared as described in Example 1 and coated on one side of a subbed, polyester support to give a dry coating weight of about 12 mg/m$^2$. This antistat layer was coated with a protective layer containing both a solvent dispersed polyurethane and a dispersed, core-shell polymer particle such as those described in U.S. Pat. Nos. 5,597,680 and 5,597,681. The core-shell particle consisted of a core comprising polymethyl methacrylate and a shell comprising a copolymer of 80% by weight methyl methacrylate and 20% by weight methacrylic acid, with the core to shell weight ratio equal to 70/30. This protective overcoat layer consisted of the following components:

| | |
|---|---|
| Witcobond W232 (Witco Chemical), 30% solids | 7.50% |
| core-shell polymer particle, 1.50% solids | 15.00% |
| Michemlube 160 (Michelman Chemical), 10 solids % | 0.20% |
| Methanol | 51.30% |
| Acetone | 33.70% |
| Water | 5.80% |

The above 3.47 percent solids composition had a viscosity of 2.6 cps. It was applied as a protective overcoat on the antistat layer to give a dry coating weight of about 1000 mg/m$^2$. This structure had an internal electrical resistivity of about 8.1 log ohm/square and remained unchanged when processed in a standard ECP-2 Color Print process. The Taber abrasion percent haze value for the protective overcoat was 11.0% and the coefficient of friction was 0.18.

Example 4

An antistat formula was prepared as described in Example 2 and coated on one side of a unsubbed, triacetate support to give a dry coating weight of about 12 mg/m$^2$. This antistat layer was coated with a protective overcoat containing both a solvent dispersed polyurethane and a solvent soluble cellulose nitrate polymer. This protective layer consisted of the following components:

| | |
|---|---|
| Witcobond W232 (Witco Chemical), 30% solids | 7.50% |
| Cellulose nitrate (SNPE North America) | 2.10% |
| Michemlube 124 (Michelman Chemical), 10% solids | 0.20% |
| Methanol | 51.30% |
| Acetone | 33.10% |
| Water | 5.80% |

The above composition had a viscosity of 1.5 cps and was applied as a protective overcoat on the antistat layer to give a dry coating weight of about 1000 mg/m$^2$. This structure had an internal electrical resistivity of about 8.2 log ohm/square and remained unchanged when processed in a standard ECP-2 Color Print process. The Taber abrasion percent haze value for the protective overcoat was 13.5% and the coefficient of friction was 0.21.

Example 5

A subbing solution for improving adhesion between an antistat layer and polyester base was prepared from the components as shown below.

| | |
|---|---|
| Witcobond W232, 30% solids | 3.34% |
| Methanol | 58.00% |
| Acetone | 38.66% |

This subbing solution was applied to an unsubbed polyester support at 100 mg/m$^2$ and dried. The antistat formula described in Example 1 was prepared, coated over this subbing layer at about 12 mg/m$^2$ and dried. Next the protective overcoat formula described in Example 1 was prepared, coated over this antistat layer at about 1000 mg/m$^2$ and dried. These coatings were clear and smooth with good adhesion to the polyester base. The antistat layer has good conductivity as measured by an internal electrical resistivity value of 7.9 log ohm/square.

Example 6

A conductive metal oxide antistat layer formula was prepared with indium antimonate particles as shown in the following composition.

| | |
|---|---|
| Witcobond W232, 30% solids | 0.66% |
| Indium antimonate dispersion in methanol, 20.5% solids. (Nissan Chemical) | 3.90% |
| Methanol | 57.26% |
| Acetone | 38.18% |

This antistat formula was coated on unsubbed triacetate base at about 300 mg/m$^2$ and dried. This coating was clear and smooth with good adhesion to the triacetate base. The internal electrical resistivity of this antistat layer was 7.7 log ohm/square.

As shown by the above examples, the coating compositions employed in this invention, namely compositions comprising a liquid organic medium as a continuous phase and polyurethane polymer particles as a disperse phase, are capable of forming a continuous film under rapid drying conditions such as are typically utilized in the manufacture of imaging elements. Any of a wide variety of layers commonly incorporated in imaging elements can be improved in performance characteristics by use of the dispersed polyurethane particles.

The invention has been described in detail, with particular reference to certain preferred embodiments thereof, but it should be understood that variations and modifications can be effected within the spirit and scope of the invention.

We claim:

1. A method for forming an imaging element for use in an image-forming process, comprising coating a support with an image-forming layer and at least one layer from a composition comprising a dispersion of aqueous dispersible polyurethane polymer particles dispersed in a continuous liquid phase comprising primarily water-miscible organic solvent.

2. A method as claimed in claim 1, wherein the water-miscible organic solvent comprises acetone, methanol, ethanol, n-propanolm iso-propanol, N-methyl pyrrolidone, propylene glycol ethers, propylene glycol ether esters, ethylene glycol ethers, ethylene glycol ether esters, or a mixture thereof.

3. A method as claimed in claim 1, wherein the water-miscible organic solvent comprises acetone, methanol, ethanol, or a mixture thereof.

4. A method as claimed in claim 1, wherein the continuous liquid phase contains up to 40 weight percent organic solvent which is not infinitely water-miscible.

5. A method as claimed in claim 1, wherein the continuous liquid phase comprises up to 40 weight percent methyl ethyl ketone, butanol, ethyl acetate, propyl acetate, isopropyl acetate, butyl acetate, toluene, or a mixture thereof.

6. A method as claimed in claim 1, wherein the continuous liquid phase comprises less than 30 weight % water.

7. A method as claimed in claim 1, wherein the continuous liquid phase comprises less than 20 weight % water.

8. A method as claimed in claim 1, wherein the aqueous-dispersible polyurethane is formed from an isocyanate terminated prepolymer which is functionalized with hydrophilic groups which are introduced into the prepolymer prior to chain extension or as part of a polymer chain extension agent.

9. A method as claimed in claim 8, wherein the aqueous-dispersible polyurethane is anionically stabilized and comprises carboxylate or sulfonate functionalized co-monomers.

10. A method as claimed in claim 8, wherein the aqueous-dispersible polyurethane is cationically stabilized by incorporation of diols containing tertiary nitrogen atoms, which are converted to the quaternary ammonium ion by the addition of an alkylating agent or acid.

11. A method as claimed in claim 8, wherein the aqueous-dispersible polyurethane is nonionically stabilized by diol or diisocyanate co-monomers bearing pendant polyethylene oxide chains.

12. A method as claimed in claim 8, wherein the aqueous-dispersible polyurethane is stabilized by a combination of nonionic and anionic stabilization.

13. A method as claimed in claim 1, wherein said element is a photographic element.

14. A method as claimed in claim 1, wherein said image-forming layer is a silver halide emulsion layer.

15. A method as claimed in claim 1, wherein said at least one layer coated from a composition comprising a dispersion of aqueous dispersible polyurethane polymer particles is a subbing layer, backing layer, interlayer, overcoat layer, receiving layer, barrier layer, stripping layer, mordanting layer, scavenger layer, antikinking layer or transparent magnetic layer.

16. A method as claimed in claim 1, wherein said support is an acetate or polyester film support.

17. A method as claimed in claim 1, wherein said composition comprising a dispersion of polymer particles contains up to 50 percent by weight of solution polymer.

18. A method as claimed in claim 1, wherein said at least one layer coated from a composition comprising a dispersion of aqueous dispersible polyurethane polymer particles comprises a protective overcoat layer containing matte particles and a lubricant.

19. A method as claimed in claim 1, wherein said composition comprising a dispersion of polymer particles has a concentration of from 0.1 to 20 wt percent total solids and a viscosity of from 0.5 to 50 centipoise.

* * * * *